United States Patent [19]

Kawakami et al.

[11] Patent Number: 4,833,118

[45] Date of Patent: May 23, 1989

[54] HEAT-SENSITIVE RECORDING MATERIAL

[75] Inventors: Hiroshi Kawakami; Akira Igarashi; Ken Iwakura, all of Shizuoka, Japan

[73] Assignee: Fuji Photo Film Co., Ltd., Kanagawa, Japan

[21] Appl. No.: 165,953

[22] Filed: Mar. 9, 1988

[30] Foreign Application Priority Data

Mar. 10, 1987 [JP] Japan ..... 62-54637

[51] Int. Cl.[4] ..... B41M 5/18

[52] U.S. Cl. ..... 503/208; 427/152; 428/193; 503/200; 503/226

[58] Field of Search ..... 503/200, 208, 209, 226

[56] References Cited

U.S. PATENT DOCUMENTS 4,484,205 11/1984 Ogata et al. ..... 503/226

*Primary Examiner*—Bruce H. Hess

*Attorney, Agent, or Firm*—Sughrue, Mion, Zinn, Macpeak & Seas

[57] ABSTRACT

A heat-sensitive recording material is disclosed, comprising a support having thereon a subbing layer made of a pigment and a binder as main components and a heat-sensitive color forming layer comprising a color former, a color developer and a heat-fusible substance, which is positioned over the subbing layer, wherein the subbing layer contains an aryl ester derivative or aryl carbonate derivative, having a melting point of 75° C. or above.

The heat-sensitive recording material is excellent in dot reproducibility.

5 Claims, No Drawings

HEAT-SENSITIVE RECORDING MATERIAL

FIELD OF THE INVENTION

The present invention relates to a heat-sensitive recording material. More particularly, the present invention relates to a heat-sensitive recording material comprising a heat-sensitive color forming layer and a subbing layer.

BACKGROUND OF THE INVENTION

Many heat-sensitive recording processes have long been known. For example, heat-sensitive recording materials comprising a color former and a color developer are described in Japanese Patent Publication Nos. 14039/70 and 4160/68. A heat-sensitive recording material comprising a diazo compound is disclosed in Japanese Patent Application (OPI) No. 190886/84 (the term "OPI" as used herein means an "unexamined published Japanese patent application").

In recent years, such heat-sensitive recording systems have been widely applied to facsimile machines, printers, labels, and the like and have found growing needs. Accordingly, improvements in the properties of the heat-sensitive systems have been required which had not been so important heretofore. One of the properties which require improvement is dot printing reproducibility.

In general, a heat-sensitive recording paper undergoes printing when heated by a 100 $\mu m \times 200$ $\mu m$ micro heating element called a thermal head. It has been found that it is important for the heat-sensitive material to be able to make a faithful reproduction of the desired shape of the micro heating element. This ability is called dot printing reproducibility.

SUMMARY OF THE INVENTION

It is therefore an object of the present invention to provide a high printing quality heat-sensitive recording material which provides excellent dot reproducibility.

The above and other objects of the present invention will become more apparent from the following detailed description and examples.

These objects of the present invention are accomplished with a heat-sensitive recording material comprising a support having thereon a subbing layer made of a pigment and a binder as main components and a heat sensitive color forming layer comprising a color former, a color developer, and a heat-fusible substance, which is positioned over the subbing layer, wherein the subbing layer contains an aryl ester derivative or aryl carbonate derivative, having a melting point of 75° C. or above.

An example has been known in which wax or wax-like material is incorporated in a subbing layer in an amount of 10 to 60% by weight based on the weight of the component of the subbing layer. Applicants have found, however, that the use of an arylester derivative or arylcarbonate derivative, having a melting point of 75° C. or above as a heat-fusible substance provides a heat-sensitive recording material having an especially excellent dot reproducibility.

DETAILED DESCRIPTION OF THE INVENTION

The present aryl ester derivative or aryl carbonate derivative to be used in the subbing layer may be represented by formula (I) or (II):

$$Ar—COOR_1 \quad (I)$$

$$Ar—OCOOR_1 \quad (II)$$

Wherein Ar represents an aryl group; and $R_1$ represents an alkyl group or an aryl group.

The alkyl group represented by $R_1$ may be a saturated or unsaturated alkyl or cycloalkyl group, which may contain a substituent such as an aryl group, an alkoxy group, an aryloxy group, a halogen atom, an acylamino group, an aminocarbonyl group and a cyano group and the aryl group represented by Ar and $R_1$ may be a phenyl, naphthyl or heterocyclic aromatic group, which may contain a substituent such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, an acyloxy group, and a phenyl group.

Preferred among the substituents represented by Ar are a phenyl group and a naphthyl group. Particularly preferred among those substituents are a phenyl group and a naphthyl group substituted by one or more of an alkyl group, an alkoxy group, an aryloxy group, a halogen atom, a phenyl group, and an acyloxy group.

Preferred among the substituents represented by $R_1$ are an alkyl group having 1 to 12 carbon atoms and an aryl group having 6 to 20 carbon atoms. Particularly preferred among those substituents are an unsubstituted aryl group and an aryl group substituted by an alkoxy group, a halogen atom, an acyl group or an aryl group.

Specific examples of such an aryl ester derivative and aryl carbonate derivative include $\beta$-p-phenylphenoxy ethyl ester benzoate, $\beta$-p-phenylphenoxy ester p-toluate, $\beta$-naphthyl(2) oxy ethyl ester benzoate, terephthalic dibenzyl ester, isophthalic dibenzyl ester, naphthoic phenyl ester, p-chlorophenyl ester p-toluate, p-tolyl ester p-toluate, ditolyl carbonate, p-biphenyl benzyl carbonate, naphthyl benzyl carbonate, naphthyl phenyl carbonate, 1,4-bis(methoxycarbonyloxy)benzene, and 1,3-bis(phenoxycarbonyloxy)benzene.

The amount of such an aryl ester derivative or aryl carbonate derivative to be added is preferably in the range of 1 to 20% by weight, particularly 1 to 10% by weight, based on the weight of the pigment in the subbing layer. Strangely, such an effect does not appear in the range of less than 1% by weight. Printing sensitivity is reduced in the range of more than 20% by weight.

As the pigment to be incorporated in the subbing layer, there can be used any commonly used organic or inorganic pigment, particularly having an oil absorption of 40 cc or more per 100 g of pigment as determined by JIS-K 5101. Specific examples of such a pigment include calcium carbonate, barium sulfate, titanium oxide, talc, zinc oxide, kaolin, calcined kaolin, aluminum hydroxide, amorphous silica, powdered urea-formalin resin, and powdered polyethylene resin. The amount of the pigment to be incorporated is in the range of 1 to 15 $g/m^2$, preferably 2 to 10 $g/m^2$ of the subbing layer.

As the binder to be incorporated in the subbing layer, there can be used a water-soluble high molecular weight compound or water-insoluble binder. Such binders may be used singly or in combination.

Specific examples of such a water-soluble high molecular weight compound include methyl cellulose, carboxy methyl cellulose, hydroxy ethyl cellulose, starch, gelatin, gum arabic, casein, styrene-maleic anhydride copolymer hydrolyzate, ethylene-maleic anhydride copolymer hydrolyzate, isobutylene-maleic anhydride copolymer hydrolyzate, polyvinyl alcohol, carboxy-modified polyvinyl alcohol, and polyacrylamide.

As the water-insoluble binder there can normally be used a synthetic rubber latex or synthetic resin emulsion. Specific examples of such binders include styrene-butadiene rubber latex, acrylonitrile-butadiene rubber latex, acrylic methyl-butadiene rubber latex, and acetic vinyl emulsion.

The amount of the binder to be incorporated is in the range of 3 to 100%, preferably 5 to 50%, based on the weight of pigment in the subbing layer. The present subbing layer may further contain wax, discoloration inhibitor, surface active agent, or the like.

Specific examples of color formers to be incorporated in the heat-sensitive color forming layer used in the present invention include various known compounds such as triarylmethane phthalide compounds, xanthene compounds including fluorans and rhodamine lactams, phenothiazine compounds, indolyl phthalide compounds, diphenyl methane compounds including leucoauramines, triazene compounds, spiropyran compounds, and fluorene compounds.

Specific examples of the above-mentioned phthalide compounds are described in U.S. Re. Pat. No. 23,024, and U.S. Pat. Nos. 3,491,111, 3,491,112, 3,491,116, and 3,509,174. Specific examples of the above-mentioned fluoran compounds are described in U.S. Pat. Nos. 3,624,107, 3,627,787, 3,641,011, 3,462,828, 3,681,390, 3,920,510, and 3,959,571. Specific examples of the above-mentioned fluorene compounds are described in Japanese Patent Application No. 240989/86. Specific examples of spiropyran compounds are described in U.S. Pat. No. 3,971,808. Specific examples of the pyridine and pyrazine coloring compounds are described in U.S. Pat. Nos. 3,775,424, 3,853,869, and 4,246,318.

Specific examples of these compounds include triarylmethane compounds such as 3,3-bis(p-dimethylaminophenyl)-6-dimethylamino phthalide (i.e., Crystal Violet Lactone), 3,3 bis(p-dimethylaminophenyl)phthalide, 3-(p-dimethylaminophenyl)-3-(1,3-dimethylindol-3-yl)phthalide, and 3-(4-doethylamino-2-ethoxyphenyl)-3-(1-ethyl-2-methylindol-3-yl)phthalide; diphenylmethane compounds such as 4,4'-bis-dimethylaminobenzhydrinbenzyl ether, N-halophenyl-leucoauramine and N-2,4,5-trichlorophenyl-leucoauramine; xanthene compounds such as Rhodamine-B-anilinolactam, Rhodamine (p-nitrino)lactam, 2-(dibenzylamino)fluoran, 2-phenylamino-6-diethylamino-fluoran, 2-(o-chloroanilino)-6-diethylaminofluoran, 2-(3,4-dichloroanilino)-6-diethylaminofluoran, 2-anilino-3-methyl-6piperidinofluoran, 2-phenyl-6-diethylaminofluoran, and 3,6-bis(diphenylamino)fluoran; thiazine compounds such as Benzo Leuco Methylene Blue and p-nitrobenzyl Leuco Methylene Blue; and spiropyran compounds such as 3-methyl-spiro-dinaphthopyran, 3-ethyl-spiro-dinaphthopyran, 3,3'-dichloro-spiro-dinaphthopyran, 3-benzylspiro-dinaphthopyran, 3-methylnaphtho-(3-methoxy-benzo)-spiropyran, and 3-propyl-spiro-dibenzopyran. These compounds may be used singly or in combination.

Particularly, color formers such as triarylmethane compounds (e.g. Crystal Violet Lactone, 3-(4-dialkylamino-2-alkoxyphenyl)-3-(1-alkyl-2-methylindol-3-yl)phthalide, and 3-(4-dialkylamino-2-alkoxyphenyl)-3-(1-alkyl-2-methylindol-3-yl)-4-azaphthalide), and xanthene compounds (e.g., 3,6-bisdiarylaminofluoran, and 2-substituted amino-6-substituted aminofluoran) are generally less subject to fog and provide a high color density and, thus, may be preferably used.

One of examples of color formers which may be particularly preferably used in the present invention is a xanthene compound represented by formula (III):

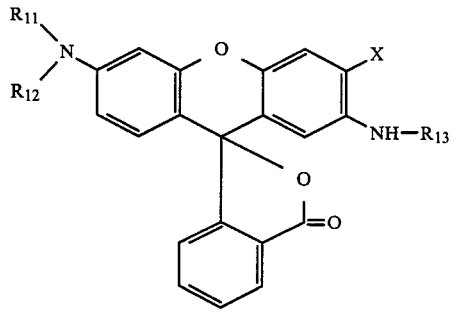

(III)

wherein $R_{11}$ and $R_{12}$, which may be the same or different, each represents a straight-chain, branched or cyclic, substituted or unsubstituted alkyl group having from 1 to 10 carbon atoms. Furthermore, $R_{11}$ and $R_{12}$ may be bonded to each other to form a 5- to 7-membered heterocyclic group.

In formula (III), $R_{13}$ represents an aryl group, preferably an aryl group having 6 to 20 carbon atoms, particularly a phenyl group or a phenyl group containing a substituent. Preferred examples of such a substituent include an alkyl group having 1 to 10 carbon atoms.

X is preferably a hydrogen atom, an alkyl group having 1 to 10 carbon atoms, an alkoxy group having 1 to 10 carbon atoms, a phenyl group, or a halogen atom.

Examples of such a xanthene compound of formula (III) will be shown hereinafter, but the present invention should not be construed as being limited thereto.

Specific examples of such a xanthene compound include 2-anilino-3-methyl-6-dimethylaminofluoran, 2-anilino-3-methyl-6-N-methyl-N-ethylaminofluoran, 2-anilino-3-methyl-6-N-methyl-N-(iso-propyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethylaminofluoran, 2-anilino-3-chloro-6-dimethylaminofluoran, 2-anilino-3-methyl-6-N-ethyl-N-isoamylaminofluroan, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-chloro-6-N-methyl-N-(iso-propyl)aminofluoran, 2-anilino-3-chloro 6-N-methyl-N-pentylaminofluoran, 2-anilino-3-chloro-6-N-methyl-N-cyclohexylaminofluoran, 2-anilino-3-methyl-6N-ethyl-N-pentylaminofluoran, 2-anilino-3 chloro-6-N-ethyl-N pentylaminofluoran, 2-(p-methylanilino)-3-methyl-6-dimethylaminofluoran, 2-(p-methylanilino)-3-methyl-6-diethylaminofluoran, 2-(p-methylanilino)-3-methyl-6-N-methyl-N-ethylaminofluoran, 2-(p-methylanilino)-3-methyl-6-N-methyl-N-(iso-propyl)aminofluoran, 2-(p-methylanilino)-3-methyl-6-N-methyl-N-pentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl-N-ethylaminofluoran, 2-(p-methylanilino)-3-chloro-6-N-methyl-N-(iso-propyl-)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran, 2-anilino-3-ethyl-6-N-methyl-N-furylmethylaminofluoran, and 2,2-bis[4-{6'-(N-ethyl-N-isoamylamino)-3'-methylspiro[phthalide 3,9'-xanthene]-2'-ylamino}phenyl]propane. These compounds may be used singly. In order to adjust tone and inhibit discoloration of developed images, these compounds may be used in combination.

The color developers which may be preferably used in the heat-sensitive color forming layer which is used in the present invention are represented by the following formulae (IV) to (VII):

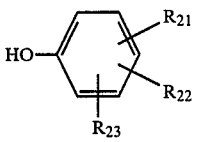

(IV)

wherein $R_{21}$ and $R_{22}$, which may be the same or different, each represents a hydrogen atom, an alkyl group, an alkoxy group, an aryl group, an arylsulfonyl group, an alkoxycarbonyl group, an aryloxycarbonyl group, an N-substituted carbamoyl group, or a halogen atom; and $R_{23}$ represents a hydrogen atom or a group represented by formula (VIII):

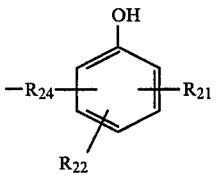

(VIII)

wherein $R_{21}$ and $R_{22}$ are as defined above: and $R_{24}$ represents a divalent group having 1 to 12 carbon atoms, or $SO_2$.

Preferred among compounds represented by formula (IV) are those wherein $R_{23}$ is a hydrogen atom and $R_{21}$ and $R_{22}$ each is a hydrogen atom or an alkoxycarbonyl group and those wherein $R_{23}$ is a group represented by formula (VIII) ih which $R_{24}$ is an alkylene group having 1 to 12 carbon atoms, a cycloakylene group having 5 to 7 carbon atoms, an aralkylene group having 8 to 12 carbon atoms, —CO—, or $SO_2$.

In formulae (IV) and (VIII) above, the alkyl group represents a saturated or unsaturated alkyl or cycloalkyl group which may contain a substituent such as aryl group, alkoxy group, aryloxy group, halogen atom, or cyano group.

Specific examples of the compounds represented by formula (IV) include 4-phenylphenol, bisphenolsulfone, p-phenylsulfonylphenol, p-tolylsulfonylphenol, bis(3-vinyl-4-hydroxyphenyl)sulfone, 2,2-bis(3-vinyl-4-hydroxyphenyl)propane, bis-3-allyl-4-hydroxyphenylsulfone, hexyl-4-hydroxybenzoate, 2,2'-dihydroxybiphenyl, 2,2-bis(4-hydroxyphenyl)propane, 4,4'-isopyridenebis(2-methylphenol), 1,1-bis-(3-chloro-4-hydroxyphenyl)cyclohexane, 1,1-bis(3-chloro-4-hydroxyphenyl)-2-ethylbutane, 4,4'-secondary-isooctylidenediphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis(4'-hydroxycumyl)benzene, bis(3-allyl-4-hydroxyphenyl)sulfone, 1,3-bis(4'-hydroxycumyl)benzene, 4,4'-thiobis(6-tert-butyl-3-methylphenol), 4,4'-dihydroxydiphenylsulfone, hydroquinonemonobenzylether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5 bis-p-hydroxyphenylpentane, 1,6-bis-p-hydroxyphenoxyhexane, tolyl 4-hydroxybenzoate, α-phenylbenzylester 4-hydroxybenzoate, phenylpropyl 4hydroxybenzoate, phenethyl 4-hydroxybenzoate, p-chlorobenzyl 4-hydroxybenzoate, p-methoxybenzyl 4-hydroxybenzoate, benzylester 4-hydroxybenzoate, m-chlorobenzylester 4-hydroxybenzoate, β-phenethylester 4-hydroxybenzoate, 4-hydroxy-2',4'-dimethyldiphenylsulfone, β-phenethyl orsellinate, cinnamyl orsellinate, o-chlorophenoxyethyl ester orsellinate, o-ethylphenoxy ethyl orsellinate, m-phenylphenoxyethyl orsellinate, β-3't-butyl-4'-hydroxyphenoxyethylester 2,4-dihydroxybenzoate, 1-t-butyl-4-p-hydroxyphenylsulfonyloxybenzene, 4-N-benzylsulfamoylphenol, p-methylbenzylester 2,4-dihydroxybenzoate, β-phenoxyethylester 2,4-dihydroxybenzoate, benzylester 2,4-dihydroxy-6-methylbenzoate, and methyl bis-4-hydroxyphenylacetate.

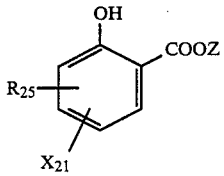

(V)

wherein $R_{25}$ represents a hydrogen atom, a halogen atom, a hydroxy group, an acyl group, an aryl group or an alkyl group; X represents an alkyl group, an alkoxy group, or a halogen atom; and Z represents a hydrogen atom or $M^{1/n}$ (wherein M represents a metallic atom having n valencies; and n represents an integer of 1 to 3).

In formula (V) above, the alkyl group represents a saturated or unsaturated alkyl or cycloalkyl group. The alkyl, acyl, or alkoxy group of formula (V) may contain a substituent such as an aryl group, an alkoxy group, an aryloxy group, a halogen atom, an acylamino group, an aminocarbonyl group, or a cyano group.

The above-described aryl group represents a phenyl group, naphthyl group or heterocyclic aromatic group which may contain a substituent such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, and a phenyl group.

Preferred among the substituents represented by $R_{25}$ are a hydrogen atom, a phenyl group, and an alkyl group having 1 to 22 carbon atoms.

Preferred among the substituents represented by $X_{21}$ are an alkyl group having 1 to 22 carbon atoms, an alkoxy group having 1 to 20 carbon atoms, a chlorine atom, and a fluorine atom.

Preferred among the metallic atoms represented by M are zinc, aluminum, magnesium, and calcium.

Preferred among the substituents for the alkyl or alkoxy group represented by $X_{21}$ are an aryl group having 6 to 12 carbon atoms, an aryloxy group having 6 to 16 carbon atoms, an alkoxy group having 1 to 12 carbon atoms, a halogen atom, and an alkoxycarbonyl group.

The salicylic acid derivatives represented by formula (V) of the present invention is preferably a compound containing 14 or more carbon atoms, particularly 16 or more carbon atoms in view of the water-insolubility of such compounds. Such a salicylic acid derivative may be used in the form of a metallic salt or a dispersion which has undergone salt formation, adsorption or double decomposition in the presence of zinc oxide.

Specific examples of such a salicylic acid derivative include 4-pentadecylsalicylic acid, 3-phenylsalicylic acid, 3-cyclohexylsalicylic acid, 3,5-di-t-butylsalicylic acid, 3,5-di-dodecylsalicylic acid, 3-methyl- 5-benzylsalicylic acid, 3-phenyl-5-(α,α-dimethylbenzyl)salicylic acid, 3,5-di(α-methylbenzyl)salicylic acid, 3,5-di-t-octylsalicylic acid, 5-tetradecylsalicylic acid, 5-hexadecylsalicylic acid, 5-octadecylsalicylic acid, 5-α-(p-α-methylbenzylphenyl)ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxyethoxysalicylic acid, 4-β- p-ethylphenoxyethoxysalicylic acid, 4-β-p-methoxyphenoxyethoxysalicylic acid, 4-β-p-ethoxyphenoxyethoxysalicylic acid, 4-β-m-tolyloxyethoxysalicylic acid, 4-β-o-tolyloxyethoxysalicylic acid, and 4-(8 -phenoxyoctyloxy)salicylic acid.

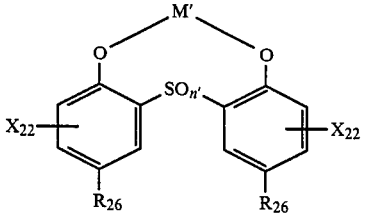

(VI)

wherein $R_{26}$ represents a hydrogen atom, an aryl group, an alkyl group, or a halogen atom; $X_{22}$ represents a hydrogen atom, an alkyl group, an alkoxy group, a carboxy group, or a halogen atom; M' represents a divalent metal; and n' represents an integer of 0, 1 or 2.

Specific examples of the compounds represented by formula (VI) include zinc, nickel and magnesium salts of bis(2-hydroxy-5-butylphenyl)sulfone, bis(2-hydroxy-5-phenylphenyl)sulfone, bis(2-hydroxy-5-octylphenyl)-sulfone, bis(2-hydroxy-5-chlorophenyl)sulfone, and bis(2-hydroxy-3-chloro-5-butylphenyl)sulfone.

$$(R_{27})_2Zn(A)_2 \quad \text{(VII)}$$

wherein $R_{27}$ represents a unidentate or multidentate, colorless organic ligand which is bonded to a zinc ion via a hetero atom to form a complex; and A represents SCN, Cl or a benzoate anion having an electron-attracting group.

Preferred among colorless organic ligands represented by $R_{27}$;are pyridine, imidazole, quinoline, benzothiazole, benzimidazole, and antipyrine ligands which may be substituted by an alkyl group, a cyano group, an alkoxy group, a phenyl group, an amino group, a formyl group, a hydroxy group, a vinyl group, or the like.

Specific examples of the compounds represented by formula (VII) include imidazole complex, 2-phenylimidazole complex, picoline complex, pyridine complex, 2benzylimidazole complex, benzimidazole complex, 2,3-dimethyl-1-phenyl-3-pyrazoline-5-one complex, 1-phenyl-2-methyl-3-benzyl-3-pyrazoline-5-one complex, 1-phenyl-2-methyl-3-(2-ethylhexyl)-3-pyrazoline-5-one complex, 1-phenyl-2-methyl-3-isopropyl-3-pyrazoline-5-one complex, 1-phenyl-2,3-dibenzyl-pyrazoline-5-one complex, and 1phenyl-2-benzyl-3-methyl-pyrazoline-5-one complex of zinc thiocyanate. These ligands may be used singly or in combination.

As the heat-fusible substance to be incorporated in the present heat-sensitive color forming layer there may be preferably used a compound containing at least one aromatic ring and at least one ether, ester or carbonyl group or compound having at least one amide, urea or urethane bond and 10 or more carbon atoms, which has a melting point of 70° to 150° C. and a water-solubility of 25 g/100 g-$H_2O$ at 25° C. Specific examples of such a heat-fusible substance include compounds represented by the following formulae (IX) to (XIV):

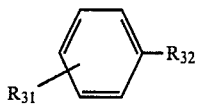

(IX)

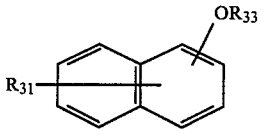

(X)

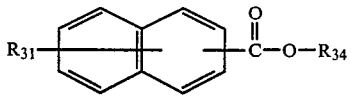

(XI)

$$R_{35}NHCONH_{32} \quad \text{(XII)}$$

$$R_{36}CONH—R_{37} \quad \text{(XIII)}$$

wherein $R_{31}$ represents a hydrogen atom, an alkyl group, an alkoxy group, a hydroxy group, an aryl group, or a halogen atom; $R_{32}$ represents an alkyl group, an alkoxy group, an acyl group, an alkoxycarbonyl group, or an aryloxycarbonyloxy group; $R_{33}$ and $R_{34}$ each represents an alkyl group or an aryl group; $R_{35}$ and $R_{36}$ each represents an alkyl group having 12 to 24 carbon atoms, an aryloxymethyl group, or a benzyl group; and $R_{37}$ represents a phenyl group.

In the formulae (IX) to (XIII), all the groups represented by $R_1$ to $R_7$ may be substituted.

If the phenyl or benzyl group represented by $R_{31}$ to $R_{34}$ in the formulae (IX) to (XIII) is substituted by a lower alkyl group, the substituent contains 1 to 8 carbon atoms, preferably 1 to 3 carbon atoms. If it is substituted by a halogen atom, the halogen atom is preferably a fluorine atom.

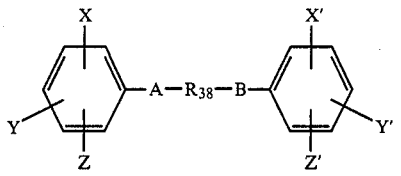

(XIV)

wherein A and B each represents an oxygen atom, a sulfur atom, —CO—, —$CO_2$— or —$CO_2C_nH_{2n}O$— in which n represents an integer of 1 to 5; $R_{38}$ represents a divalent group, preferably an alkylene group, an alkylene group containing a carbonyl group, an alkylene group containing a halogen atom, or an alkylene group containing an unsaturated bond, and particularly preferably an alkylene group or an alkylene group containing an ether bond; and X, Y, Z, X', Y', and Z' may be the same or different and each represents a hydrogen atom, an alkyl group, an alkoxy group, a halogen atom, an alkyloxycarbonyl group, an acyl group, an alkylthio group, or a cyano group.

The compounds represented by the formulae (IX) to (XIV) preferably have a melting point of 70° to 150° C., particularly preferably 80° to 140° C. Specific examples of such compounds as the heat-fusible substances include benzyl p-benzyloxybenzoate, β-naphthylbenzylether, stearamide, palmitamide, N-phenylstearic amide, N-stearyl urea, β-naphthoic phenylester, 1-hydroxy-2-naphthoic phenylester, β-naphthol(p-chlorobenzyl)ether, β-naphthol(p-methylbenzyl)ether, α-naphthylbenzylether, 1,4-butanediol-p-methylphenylether, 1,4-propanediol p-methylphenylether, stearic amide, 1,4-butanediol-p-isopropylphenylether, 1,4-butanediol-p-t-octylphenylether, 2-phenoxy-1-p-tolyloxyethane, 1-phenoxy-2-(4-ethylphenoxy)ethane, 1-phenoxy-2-(4-chlorophenoxy)ethane, 1,4-butanediol-phenylether, diethyleneglycol-bis(4-methoxy-phenyl)ether, p-ethylphenoxyacetic benzylamide, phenylacetic benzylamide, acetylbiphenyl, benzylbiphenyl, and ditolyl carbonate.

The above described heat-fusible substances may be used singly or in combination. In order to obtain a sufficient heat response, the heat-fusible substance is preferably used in an amount of 10 to 200% by weight, particularly 20 to 150% by weight based on the weight of the color developer.

The process for the preparation of a typical heat-sensitive recording material of the present invention will be described hereinafter.

A pigment and an aryl ester derivative are ground and dispersed in separate dispersion media. As such a dispersion medium there is normally used a 0.5 to 10% concentration aqueous solution of a water-soluble high molecular weight compound. The two dispersions thus obtained are mixed in a proper mixing ratio. Furthermore, various additives are optionally added to the mixture to obtain a coating solution. The coating solution thus obtained is coated onto a base paper, woodfree paper, synthetic paper, plastic sheet, or neutral paper in an amount of 1 to 20 g/m$^2$, preferably 2 to 10 g/m$^2$, and then dried to obtain an undercoated base paper.

A color former and a color developer are ground to a particle diameter of 10 μm or less, preferably 3 μm or less, and dispersed in separate dispersion media. As such a dispersion medium there is normally used a 0.5 to 10% concentration aqueous solution of a water-soluble high molecular weight compound. The dispersion is accomplished by means of a ball mill, sand mill, horizontal sand mill, attritor, colloid mill, or the like.

The mixing ratio of color former to color developer by weight is preferably between 1/10 and 1/1, particularly between 1/5 and ⅔.

Furthermore, a dispersion of a heat-fusible substance is added to the mixture. A sensitizer may be added to either or both of the color former and the color developer. The two components may be dispersed at the same time. Furthermore, additives are optionally added to the mixture.

For example, an oil-absorbing substance such as inorganic pigment and polyurea filler is dispersed in the binder in order to inhibit stain on the recording head upon recording. Furthermore, an aliphatic acid, metallic soap, or the like is incorporated in the coating solution in order to improve releasability from the head. Therefore, additives such as pigment, wax, antistatic agent, ultraviolet absorber, defoaming agent, electrically conductive agent, fluorescent dye, surface active agent, hindered phenol, and benzoic acid derivative are coated on the support besides colorless pigment and color developer which contribute to color development to form a recording material.

Particularly, as such a pigment there can be used kaolin, calcined kaolin, talc, diatomaceous earth, aluminum hydroxide, magnesium hydroxide, calcined plaster, silica, magnesium carbonate, titanium oxide, alumina, barium carbonate, barium sulfate, mica, microballoon, urea-formalin filler, particulate polyethylene, cellulose filler, or the like. Such a pigment preferably has a particle diameter of 0.1 to 15 μm. Specific examples of the above-mentioned wax include paraffin wax, carboxy-medified paraffin wax, carnauba wax, microcrystalline wax, polyethylene wax, and higher aliphatic acid esters.

Specific examples of the above-mentioned metallic soap include polyvalent metallic salts of a higher aliphatic acid such as zinc stearate, aluminum stearate, calcium stearate, and zinc oleate.

As the above-mentioned hindered phenol there may preferably be used a phenol derivative which is substituted by a branched alkyl group in at least one of the 2position and the 6-position.

Specific examples of such a hindered phenol include 1,1-bis(2-methyl-4-hydroxy-5-t-butylphenyl)butane, 1,1,3-tris(3-methyl-4-hydroxy-5-t-butylphenyl)butane, bis(2-hydroxy-3-t-butyl-5-methylphenyl)methane, and bis(2-methyl-4-hydroxy-5-t-butylphenyl)sulfide.

As the above-mentioned benzoic acid derivative, there may preferably be used a metallic salt of benzoic acid containing one or more electron-attracting groups. Specific examples of metallic salts of benzoic acid include zinc, aluminum, cadmium, magnesium, and calcium salts of halogen-substituted benzoic acid, nitrobenzoic acid, cyanobenzoic acid, substituted sulfonylbenzoic acid, acylbenzoic acid, substituted carbamoylbenzoic acid, alkoxycarbonylbenzoic acid, and substituted sulfamoylbenzoic acid. Such a metallic salt may also be used as a color developer. The metallic salt is coated in the form of a single dispersion or a dispersion with a color developer.

As the binder, there is normally used a water-soluble binder. Specific examples of such a water-soluble binder include polyvinyl alcohol, hydroxyethyl cellulose, hydroxypropyl cellulose, epichlorohydrin-modified polyamide, ethylene-maleic anhydride copolymer, styrene-maleic anhydride copolymer, isobutylene-maleic anhydride copolymer, polyacrylic acid, polyacrylic amide, methylol-modified polyacrylamide, starch derivative, casein, and gelatin.

In order to impart water resistance to these binders, a waterproofing agent such as gelling agent and crosslinking agent or a hydrophobic polymer emulsion, such as styrene-butadiene rubber latex, and acrylic resin emulsion may be added to these binders. The coating solution for the heat-sensitive color forming layer thus prepared is coated onto the undercoated base paper in an amount of about 2 to 10 g/m$^2$.

Furthermore, a 0.2 to 2-μm thick protective layer made of a water-soluble or water-dispersible high molecular weight compound such as polyvinyl alcohol, hydroxyethyl starch, and epoxy-modified polyacrylamide and a crosslinking agent is provided on the coated surface layer to improve the resistance of the recording material.

Furthermore, the present heat sensitive recording material can take various embodiments as described in West German Patent Application (OLS) Nos. 2,228,581, and 2,110,854, and Japanese Patent Publication No. 20142/77. Alternatively, the coated paper may be heated, moistened, or stretched in advance of recording.

The present invention will be further illustrated in the following examples, but the present invention should not be construed as being limited thereto. Unless specified otherwise, all parts, percents, rations and the like are by weight.

Each heat sensitive recording material specimen was prepared by coating a heat-sensitive coating solution onto the respective undercoated support in a dried amount of 6 g/m$^2$ by means of a wire bar, and then drying the material in a 50° C. oven.

Preparation of heat-sensitive coating solution 20 g of 2-anilino-3-methyl-N-methyl-N-cyclohexylaminofluoran as a color former, 20 g of bisphenol A as a color developer, and 20 g of bis(2-p-methoxyphenoxyethyl)ether as a heat-fusible substance were subjected to dispersion with 100 g of a 5% aqueous solution of polyvinyl alcohol (PVA-105 produced by Kuraray Co., Ltd.) in a ball mill for an entire day and night, so that the volume average particle diameter thereof became 3 μm or less. As a pigment, there was used calcium carbonate (Unibur 70 produced by Shiraishi Kogyo Co.) 80 g of calcium carbonate was dispersed with 160 g of a 0.5% solution of sodium hexamethaphosphate in a homogenzer. These dispersions were then mixed in a mixing ratio such that 5 g of 2-anilino-3-methyl-6-N-methyl-N-cyclohexylaminofluoran dispersion, 10 g of bisphenol A dispersion, 10 g of bis(2-p-methoxyphenoxyethyl)ether dispersion, and 15 g of calcium carbonate dispersion were mixed. Then, 3 g of a 21% zinc stearate emulsion was added to the mixture to obtain the desired coating solution.

EXAMPLE 1

The process for the preparation of an undercoated base paper will be described hereinafter.

As a pigment, there was used calcined kaolin (Ansilex 90, manufactured by Engelhard). 80 g of calcined kaolin was dispersed with 160 g of a 0.5% solution of sodium hexamethaphosphate in a homogenizer. 60 g of the dispersion thus obtained, 8 g of a 48% styrene-butadiene latex (Sumitomo Norgatack), and 6 g of a dispersion which had been obtained by dispersing 20 g of di-p-tolylcarbonate (m.p.: 113° C.) with 100 g of a 5% aqueous solution of polyvinyl alcohol in a ball mill for an entire day and night were mixed to obtain a coating solution. The coating solution thus obtained was then coated onto a woodfree paper having a weight of 50 g/m$^2$ by means of a wire bar in a dried amount of 6 g/m$^2$, and dried in a 50° C. oven to obtain the desired undercoated base paper. The above described heat-sensitive coating solution was coated onto the undercoated base paper to obtain a heat-sensitive recording material.

EXAMPLE 2

A heat sensitive recording material was prepared in the same manner as in Example 1, except that the di-p-tolylcarbonate dispersion incorporated in the subbing layer was replaced by a terephthalic dibenzylester dispersion. The terephthalic dibenzylester had a melting point of 95° C.

COMPARATIVE EXAMPLE 1

A heat-sensitive recording material was prepared in the same manner as in Example 1, except that the di-p-tolylcarbonate dispersion incorporated in the subbing layer in Example 1 was not used.

For the measurement of color density, printing was conducted with a printing energy of 30 mJ/mm$^2$ by means of a printing tester manufactured by Kyocera Corporation. Color density was determined by means of a Macbeth densitometer.

For the measurement of dot reproducibility, dot printing was conducted with a printing energy of 25 mJ/mm$^2$ by means of a printing tester manufactured by Kyocera Corporation. The area of 40 dots was determined by means of an image analyzer. Dot reproducibility was determined by dividing the standard deviation of the area by average value of the area. The smaller the value is, the better is dot reproducibility.

TABLE 1

| Specimen No. | Amount of ester or carbonate based on weight of the piqment | Color density | Dot reproducibility |
|---|---|---|---|
| Example 1 | 5% | 1.18 | 0.067 |
| 2 | 5% | 1.13 | 0.068 |
| Comparative Example 1 | 0% | 1.03 | 0.103 |

Table 1 shows that the heat-sensitive recording material specimens of the present invention exhibit excellent dot reproducibility.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a subbing layer made of pigment and a binder as main components and a heat-sensitive color forming layer comprising a color former, a color developer and a heat-fusible substance, which is positioned over the subbing layer, wherein the subbing layer contains an aryl ester derivative or aryl carbonate derivative, having a melting point of 75° C. or above, wherein the aryl ester derivative or aryl carbonate derivative is represented by formula (I) or (II)

$$Ar—COOR_1 \quad (I)$$

$$AR—OCOOR_1 \quad (II)$$

wherein Ar represents an aryl group, and $R_1$ represents an alkyl group or an aryl group.

2. A heat-sensitive recording material as claimed in claim 1, wherein Ar represents a substituted or unsubstituted phenyl group or a substituted or unsubstituted naphthyl group and $R_1$ represents an alkyl group having 1 to 12 carbon atoms or an aryl group having 6 to 20 carbon atoms.

3. A heat-sensitive recording material as claimed in claim 1, wherein the amount of the aryl ester derivative or aryl carbonate derivative present in the subbing layer is within the range of from 1 to 20% by weight based on the weight of the pigment in the subbing layer.

4. A heat-sensitive recording material as claimed in claim 1, wherein the pigment incorporated in the subbing layer is one which has an oil absorption of 40 cc or more per 100 g of pigment as determined by JIS-K 5101.

5. A heat-sensitive recording material as claimed in claim 3, wherein the pigment incorporated in the subbing layer is one which has an oil absorption of 40 cc or more per 100 g of pigment as determined by JIS-K 5101.

* * * * *